United States Patent [19]

Kershaw

[11] Patent Number: 4,907,314

[45] Date of Patent: Mar. 13, 1990

[54] PIPELINE PIG

[75] Inventor: Christopher F. Kershaw, Chesterfield, United Kingdom

[73] Assignee: British Pipeline Agency Ltd., et al., Hertfordshire, United Kingdom

[21] Appl. No.: 201,687

[22] Filed: Jun. 2, 1988

[30] Foreign Application Priority Data

Jun. 4, 1987 [GB] United Kingdom ..... 8713071

[51] Int. Cl.[4] ..... B08B 9/02

[52] U.S. Cl. ..... 15/104.061

[58] Field of Search ..... 15/104.061, 3.5, 3.51, 15/104.62, 104.63, 104.2; 137/242, 244, 268

[56] References Cited

U.S. PATENT DOCUMENTS

| | | | |
|---|---|---|---|
| 1,165,455 | 12/1915 | Schlemmer | 15/104.063 |
| 1,218,005 | 3/1917 | Schlemmer | 15/104.061 |
| 3,605,347 | 9/1971 | Barry | 15/159 A |
| 4,503,578 | 3/1985 | McIntyre | 15/104.2 X |

FOREIGN PATENT DOCUMENTS

| | | | |
|---|---|---|---|
| 1170973 | 5/1964 | Fed. Rep. of Germany | 15/104.061 |
| 802406 | 10/1958 | United Kingdom | 15/104.61 |
| 1423132 | 1/1976 | United Kingdom | 15/104.061 |

*Primary Examiner*—Edward L. Roberts

*Attorney, Agent, or Firm*—Christie, Parker & Hale

[57] ABSTRACT

A pipeline pig for pigging a fluid transporation pipeline, especially one in which a cable or other line is permanently deployed, comprises on a central tubular shaft an array of radial-bristle planar brushes which are spaced apart in planes normal to the axis of the shaft by spacers, and in some cases by groups of sail cloth diaphragms secured between spacers. The brush bristles comprise resilient plastics filaments (preferably nylon) coated with an abrasive material such as carborundum, and have a radial length such that when the pig is inserted in a pipeline, the bristles are deflected and curved rearwardly so that a substantial part of each bristle lies in contact with the internal surface of the pipeline. The leading end of the pig may comprise a deflector cone to facilitate passage of the pig past a cable deployed in a pipeline. The sail cloth diaphragms may be provided with radially extending pleats.

13 Claims, 2 Drawing Sheets

PIPELINE PIG

This invention relates to fluid transportation pipeline systems for transporting bulk liquids or gases over substantial distances, and to a means for 'pigging' the pipelines of such a system. By 'pigging' is meant the passing of a 'pig' through a pipeline between pig entry and exit hatches whereby to accomplish any one or more of the following tasks:

(i) to scrape from the internal surface of the pipeline material which has been deposited on (dirt or other foreign bodies) or otherwise developed at (rust or scale) the internal surface of the pipeline;

(ii) to gather up and expel loose rust or scale lying in the pipeline;

(iii) to gather up and expel (swab out) contaminants, such as water, lying in the pipeline; and (iv) to separate and provide an interface between different fluids flowing in a pipeline, as for example, between a product such as oil, and a purging water flow, or between a liquid product and a purging gas flow.

Known pigs commonly comprise at least two resilient cupshaped diaphragms mounted at axially spaced positions on a central shaft or mandrel. Each such diaphragm is impervious to the liquid flowing in the pipeline, and has an annular skirt portion that is intended to contact and rub against the internal surface of the pipeline, whereby to scrape from that surface material that has become deposited or is lying thereon.

It is also known to provide on such pigs brushes for scrubbing the internal surface, but only in conjunction with the afore-mentioned impervious diaphragms. Such brushes have commonly comprised a circumferentially-spaced array of longitudinally aligned individual brushes. One known pig has included ahead of the leading diaphragm a circular brush in which the bristles are arranged in a radial manner. Such brushes have an external diameter substantially equal to that of the internal diameter of the pipeline in which the pig is intended to operate.

In our concurrently-filed, co-pending patent applications U.S. Ser. No. 201,691 and U.S. Ser. No. 201,692 there is disclosed the concept of, and a method of, deploying within (instead of alongside) a fluid transportation pipeline, for transporting bulk liquids or gases, an electrical or other cable or line for transmitting data, control or other signals which need to be transmitted from one location on a pipeline system to another such location.

The presence in a pipeline of such a cable or line presents a problem in that the conventional forms of cleaning pigs cannot be used except with substantial disadvantages. In particular, (a) the resilient impervious diaphragms would be subjected to excessive deflection and distortion, so that pipeline fluid could undesirably by-pass the pig, and so permit mixing of different fluids that are to be kept separate by the pig, and (b) those diaphragms would be subjected to excessive and uneven wear, and possibly the development of grooves in their peripheral surfaces.

According to one feature of the present invention, a pipeline pig comprises at least two circular, bristle brushes in which the bristles radiate from the centre, each such brush being mounted on a central shaft or mandrel and being spaced from an adjacent brush or from each adjacent brush.

Preferably, the brushes have an external diameter that is substantially greater than the internal diameter of the pipeline in which the pig is intended to operate, whereby when the pig is inserted in a pipeline the bristles are caused to bend intermediate their fixed and free ends, and so trail at their outer parts in a rearwards direction whereby to bring a substantial length of each bristle into rubbing contact with the internal surface of the pipeline.

Those bristles may comprise resilient non-metallic or metallic elements, or a mixture of such elements. Preferably, such elements comprise filaments of a plastics material, such as nylon. Advantageously, those bristles are coated with a film or coating of a wear-resistant material, for example, an abrasive material such as carborundum.

Preferably, the shaft or mandrel is hollow and so provides some buoyancy for the pig, whereby to diminish the loading on the bristles situated for the time being at the lower side of the pig. Magnets for enabling the detection or location of the pig in a pipeline are preferably mounted within the hollow shaft.

According to another preferred feature of the present invention, there is also provided on the said shaft or mandrel one or more diaphragms of a woven fabric material, whereby to diminish the leakage across the pig. Fabric intended for use as a boat's sails (sail cloth) has been found to be satisfactory.

Preferably, the said brushes are arranged in closely spaced pairs, and a said woven fabric diaphragm in interposed in between the brushes constituting such a pair.

The assembly of brushes of such a pig preferably includes spacing members mounted on said shaft for holding the brushes and woven fabric diaphragms in a desired spatial arrangement.

Pigs according to the present invention have the advantage that their brushes and woven fabric diaphragms are able to accommodate the presence of a cable in a pipeline without impairing the cleaning efficacy of the pig, and without substantially reducing the sealing ability of the pig or causing damage to the pig components.

Other features of the present invention will become apparent from a reading of the description that follows hereafter, and of the claims appended at the end of that description.

One pipeline pig, and various modifications thereof, all according to the present invention, will now be described by way of example and with reference to the accompanying diagrammatic drawings.

Figure 1:
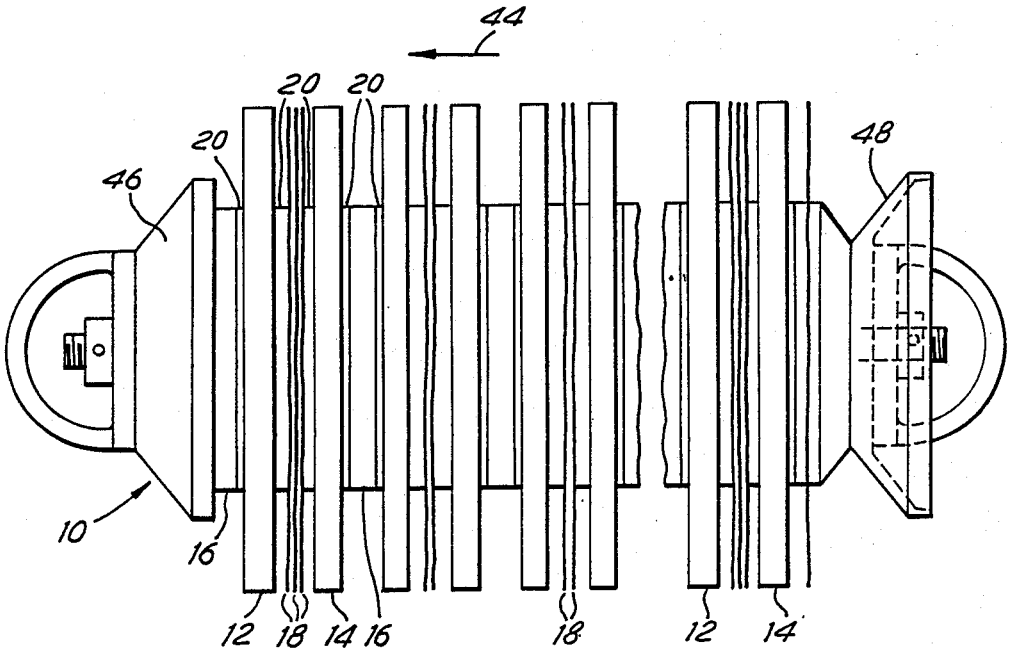
FIG. 1 shows a side elevation of the pig before its entry into a pipeline.

Referring now to the drawings, the pig there shown comprises a shaft or mandrel assembly 10 on which is carried a tightly clamped array of axially spaced pairs of brushes 12, 14. The respective pairs of brushes are spaced apart by polyurethane spacers 16.

Between the brushes of each such pair is clamped a single diaphragm 18, or a group of two, or three, diaphragms 18, of a sail cloth material. Interposed between each brush 12, 14, and the adjacent component (a diaphragm, or group of diaphragms 18, or a spacer 16) is a plastics foam washer 20.

Each such brush comprises an array of carborundum-coated, nylon filaments which radiate from a central support (not shown) and constitute the 'bristles' 22 of the brush.

The shaft assembly 10 comprises a central aluminium tube 24 having secured to the leading end thereof, by welding, a chamfered flange 26. At the trailing end of the tube is secured a screw-threaded, flanged, aluminium plug 28. Carried within the tube 24 is an array of disc magnets 30, secured in position within the tube by a clamping plate 32. A central shaft 34 extends through the tube 24, the magnet assembly 30, 32, and the associated plug 28, and carries outboard of the flange 26 and plug 28 respective handling plates 36, each of which carries a handling ring 38.

The shaft assembly 10 is secured together, after first threading on to the tube 24 the respective brushes 12, 14, the respective groups of diaphragms 18, the respective spacers 20, and the respective spacers 16, by applying nuts 40 to the screw-threaded ends of the central shaft 34, and locking those nuts by means of split pins 42. The screw threads on the ends of the shaft are left-handed threads, whereas the screw thread on the flanged plug is a righthanded thread. This ensures that in service the array of components assembled on the shaft assembly 10 cannot become loose.

The pig is intended to move through a pipeline in the direction indicated by the arrow 44 shown in FIG. 1.

After passing a first time through a pipeline, the brush bristles take up a permanently-set curvature intermediate their fixed and free ends, which curvature assists subsequent passes of the pig through a pipeline.

By way of example, the initial diameter of the brushes 12, 14 is approximately 10–10½ inches (254–267 mm), for entry into a pipeline having a nominal bore diameter of 8 inches (203 mm).

The brush bristles have to be resilient and wear resistant, and strong enough to support the weight of the pig when in a pipeline. The plastics material chosen for the bristles must also be capable of receiving the wear resistant abrasive coating material. Not only does the abrasive material coating enhance the life of the plastics bristle filaments, but it also provides a good cleaning surface for removing debris from the internal surface of a pipeline.

The shaft assembly may, if desired, be sealed to render the pig slightly buoyant in the pipeline fluid.

The brush bristles may be pre-treated so as to render them flexed in the shape that they would otherwise achieve in the course of a passage through a pipeline.

If desired, some of the sail cloth diaphragms may be omitted; and leading and trailing end cups 46, 48 of a resilient plastics material may be included in the shaft assembly.

The positioning of the sail cloth diaphragms between the brushes in the manner shown assists in maintaining the brushes in good shape for performing their intended functions.

Figure 3:
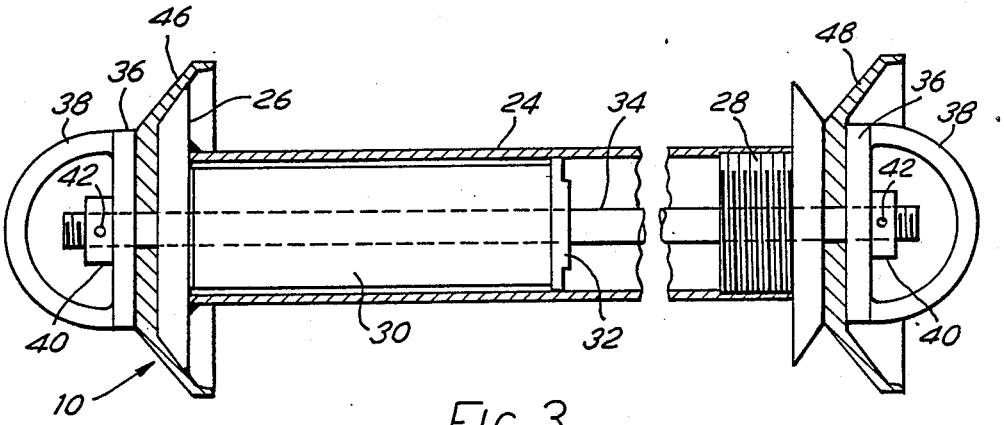
FIG. 3 shows a diametral cross section through a shaft or mandrel assembly on which an array of bristle brushes, woven fabric diaphragms and spacers is to be assembled to produce the pig shown in FIG. 1.
Figure 2:
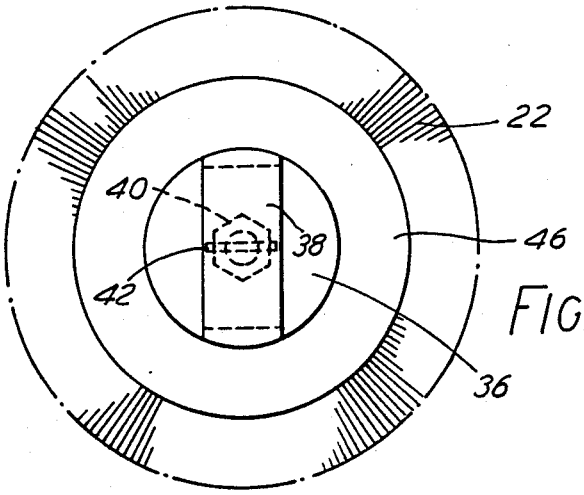
FIG. 2 shows an end view looking on the leading end of the pig shown in the FIG. 1, that is, as seen from the left hand side of FIG. 1.
Figure 4:
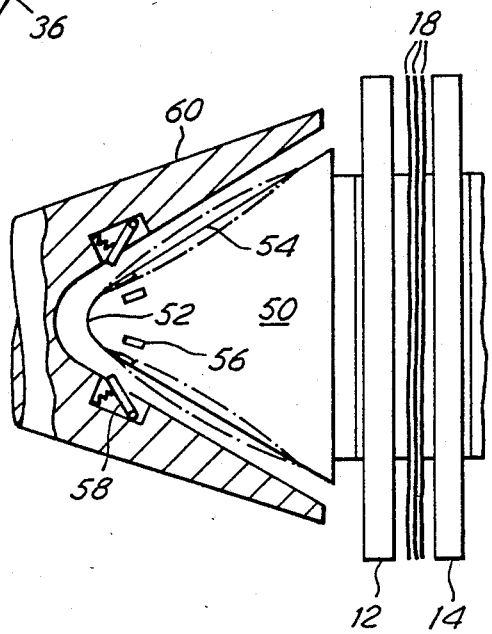
FIG. 4 shows, in a view similar to that of FIG. 1, the modified leading end part of a modified form of the pig shown in the FIGS. 1 to 3.

A modified version of the pig shown in the FIGS. 1 to 3 has at its leading end a modified form of handling plate 36, which is shown in the FIG. 4. In that modified form, the 'D' shaped handling ring 38 of FIG. 1 is replaced by a generally cone-shaped deflector 50 of polyurethane or other suitable plastics material. The deflector has a rounded nose 52, and a substantially conical profile 54 which is shaped to safely sweep aside (without inflicting any substantial damage) any electric cable or other line which is deployed in the pipeline and happens to traverse the path of the pig, for example at a position in the pipeline where such a cable or line enters or leaves the pipeline.

The said conical profile may have linear sides as illustrated, or sides which are outwardly slightly concave, or slightly convex, as indicated by chain-dotted lines.

In order to facilitate retrieval of the pig from a pipeline, the deflector is provided with a series of circumferentially spaced indents 56 into which spring-biased pawls 58 carried within a retrieval cup 60 may expand on engagement of the retrieval cup with the deflector, whereby to positively engage the deflector and so enable the pig to be withdrawn from the pipeline with the retrieval cup.

Figure 5:
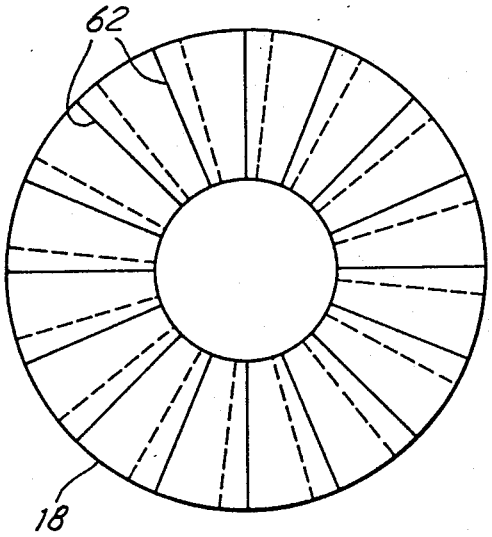
FIG. 5 shows in end view a pleated form of fabric diaphragm for use in the pigs of the FIGS. 1 to 4.

In order to enhance the flexibility of the sail cloth diaphragms, and so further facilitate the passage of the pig past an electric cable deployed in the pipeline, some or all of them may be formed with uniformly spaced, radially extending pleats as indicated in the FIG. 5 at reference 62.

I claim:

1. In a fluid transportation pipeline having a flexible signal transmitting cable or line deployed therein, a pig which comprises:

(a) a central shaft;

(b) a plurality of similar disc-shaped, radial bristle brushes carried transversely at axially-spaced positions on said central shaft;

(c) a plurality of circular, planar diaphragms of a woven fabric material carried transversely on said central shaft and disposed between and spaced from selected brushes;

(d) means for securing said brushes and diaphragms on said central shaft; and (e) a resilient conical deflector member secured on said central shaft at its leading end, said deflector member having a peripheral rim portion disposed adjacent to and facing peripheral parts of the foremost brush, and said deflector member being arranged and adapted to sweep aside said cable at any position in said pipeline where said cable crosses the path of said pig.

2. A pipeline pig according to claim 1, wherein said deflector member includes a resilient cup-shaped portion which faces rearwards towards the foremost brush, and said rim portion comprises a peripheral rim part of said cup-shaped portion.

3. A pipeline pig according to claim 2, including adjacent the rearmost brush a resilient cup-shaped member having a rim portion facing rearwards away from said rearmost brush.

4. A pipeline pig according to claim 3, wherein said brushes and diaphragms have a diameter substantially greater than the internal diameter of said pipeline so that said brushes and diaphragms are flexed rearwardly at their peripheries by movement of the pig along the pipeline.

5. A pipeline pig according to claim 4, wherein the brush bristles are preformed to a shape conforming substantially to that adopted by them when moving through the pipeline.

6. A pipeline pig according to claim 3, wherein said brush bristles comprises filaments of a resilient plastics material.

7. A pipeline pig according to claim 6, wherein said brush bristles comprise filaments of nylon.

8. A pipeline pig according to claim 6, wherein said brush bristles carry a coating of an abrasive material.

9. A pipeline pig according to claim 8, wherein said abrasive material comprises carborundum.

10. A pipeline pig according to claim 3, wherein said central shaft is hollow and sealed at its ends thereby to provide a predetermined buoyancy for the pig.

11. A pipeline pig according to claim 10, wherein said central shaft incorporates magnetic means for facilitating magnetic sensing of the pig in said pipeline.

12. A pipeline pig according to claim 1, wherein each said diaphragm is formed with a plurality of radial pleats spaced circumferentialy around the diaphragm thereby to allow the diaphragm to closely and sealingly engage said cable as the pig is propelled along said pipeline by the fluid pressure downstream thereof.

13. A pipeline pig according to claim 12, wherein said pleated diaphragms are arranged in groups of two disposed between and spaced from selected brushes.

* * * * *